US005722096A

United States Patent [19]

Pfaeffle

[11] Patent Number: 5,722,096

[45] Date of Patent: Mar. 3, 1998

[54] PORTABLE URINAL

[76] Inventor: Patricia Pfaeffle, 72 S. Charles St., Hopelawn, N.J. 08861

[21] Appl. No.: 678,118

[22] Filed: Jul. 11, 1996

Related U.S. Application Data

[63] Continuation of Ser. No. 365,071, Dec. 27, 1994, abandoned.

[51] Int. Cl.[6] ..... A47K 11/00

[52] U.S. Cl. ..... 4/144.1

[58] Field of Search ..... 4/144.1–144.4; 248/124.1, 124.2

[56] References Cited

U.S. PATENT DOCUMENTS

| | | | |
|---|---|---|---|
| 185,004 | 12/1876 | White | 248/124.1 |
| 835,678 | 11/1906 | Hammond | 248/124.1 |
| 1,440,765 | 1/1923 | Buckley | 4/114.1 |
| 3,835,857 | 9/1974 | Rogers, III et al. . | |
| 3,927,426 | 12/1975 | Geddes . | |
| 4,023,216 | 5/1977 | Li . | |
| 4,270,231 | 6/1981 | Zint . | |
| 4,309,779 | 1/1982 | Knight . | |
| 4,531,245 | 7/1985 | Lowd et al. . | |
| 4,769,858 | 9/1988 | Gamm et al. . | |
| 5,010,599 | 4/1991 | Nilsson . | |
| 5,285,532 | 2/1994 | Sealy . | |

FOREIGN PATENT DOCUMENTS

| | | | |
|---|---|---|---|
| 0930170 | 1/1948 | France | 4/144.1 |

*Primary Examiner*—Charles E. Phillips
*Attorney, Agent, or Firm*—Cobrin Gittes & Samuel

[57] ABSTRACT

A portable urinal including a urine bottle support having a receiving area. The urine bottle support includes a hollow rod and an extension rod disposed within the hollow rod. The extension rod is selectively movable in a longitudinal direction relative to the hollow rod. Further, the portable urinal includes a urine bottle selectively coupled to the urine bottle support.

3 Claims, 6 Drawing Sheets

PORTABLE URINAL

This is a continuation of application Ser. No. 08/365,071 filed 27 Dec. 1994, now abandoned.

BACKGROUND OF THE INVENTION

This invention relates generally to portable urinals and more particularly to portable stand-up urinals for disabled or partially disabled persons.

It is known in the healthcare field to employ portable in-bed or stand-up urinals for male and female bed ridden patients. Urinal bottles have been used for many years to collect urine specimens for medical analysis. More to the point, one of the most common uses for urine bottles is to allow a bed-ridden individual to urinate while lying in the prone position. Examples of such devices are set forth in the following patents:

| U.S. Pat. No. | Inventor |
|---|---|
| 3,835,857 | Rogers, III et al. |
| 3,927,426 | Geddes |
| 4,023,216 | Li |
| 4,270,231 | Zint |
| 4,309,779 | Knight |
| 4,531,245 | Lowd et al. |
| 4,769,858 | Gamm et al. |
| 5,010,599 | Nilsson |
| 5,285,532 | Sealy |

U.S. Pat. No. 3,835,857 to Rogers, III et at. discloses a male urinal device.

U.S. Pat. No. 3,927,426 to Geddes discloses a male and female urinal.

U.S. Pat. No. 4,023,216 to Li discloses a urinal device.

U.S. Pat. No. 4,270,231 to Zint discloses a portable male urinal with drain means.

U.S. Pat. No. 4,309,779 to Knight discloses a personal urinal device useable by males and females.

U.S. Pat. No. 4,531,245 to Lowd et al. discloses a personal urinal device.

U.S. Pat. No. 4,769,858 to Gamm et al. discloses a urinal bottle.

U.S. Pat. No. 5,010,599 to Nilsson discloses a portable unisex urinal.

U.S. Pat. No. 5,285,532 to Sealy discloses a portable urinal device.

There are several drawbacks to using in-bed urinal devices typical of the art. Because in-bed urinals are used in a prone position the bladder can not be completely emptied. This causes low urine output and frequent bladder infection. Further, the prone position is a difficult position from which to urinate and there is usually some leakage involved which causes skin irritations around the genitals, wet clothing, wet sheets and a wet bed.

Further, problems exist with portable stand-up urinal devices typical of the art. Stand-up urinals typical of the art pose sanitary problems. They allow for the build up of germs and bacteria which in turn raises the risk of transmitting disease or infection between different people. Further, stand-up urinals typical of the art fail to provide support for the individual using the device. These devices are typically used by disabled or bed-ridden individuals who need assistance to stand. These devices fail to provide such assistance.

Thus there exists the need for a portable urinal which can be utilized in the standing or sitting position by disabled, partially disabled or bed ridden persons.

It is accordingly an object of the invention to provide a portable urinal that can be used while standing or sitting.

It is another object of the invention to provide a portable stand-up urinal which can be used by disabled, partially disabled or bed-ridden persons.

It is a further object of the invention to provide a sanitary portable urinal that can be used while standing or sitting.

It is still another object of the present invention to provide a portable urinal that can be used while standing which provides the user with support.

Yet another object of the present invention is to provide a portable urinal that can be used while standing or sitting which is connectable to a standard walker.

Still another object of the present invention is to provide a portable urinal that can be used while standing or sitting that is positionally adjustable.

SUMMARY OF THE INVENTION

The foregoing objects are attained by the present invention, which provides a portable urinal which can be used while sitting or standing. The invention utilizes a urine bottle support having a receiving area. The urine bottle support includes a hollow rod and an extension rod disposed within the hollow rod. The extension rod is selectively movable in a longitudinal direction relative to the hollow rod. The portable urinal also includes a urine bottle selectively coupled to the urine bottle support.

In another embodiment of the invention, the invention further utilizes a collapsible stand connected to the urine bottle support.

In yet another embodiment of the invention, the invention further utilizes a standing pole connected to the urine bottle support which may be connected between the floor and ceiling of a room.

In still another embodiment of the invention the invention further utilizes a standard walker connected to the urine bottle support.

The invention will next be described in connection with certain illustrated embodiments; however, it should be clear to those skilled in the art that various modifications, additions and subtractions can be made without departing from the spirit or scope of the claims.

BRIEF DESCRIPTION OF THE DRAWINGS

For a fuller understanding of the nature and objects of the invention, reference should be made to the following detailed description and accompanying drawings, in which.

DESCRIPTION OF ILLUSTRATED EMBODIMENTS

The invention is directed to a portable urinal. This portable urinal can be utilized by males or females. It is portable and can be used in hospitals, nursing care facilities, at home, when traveling, with a disabled individual.

Figure 1:
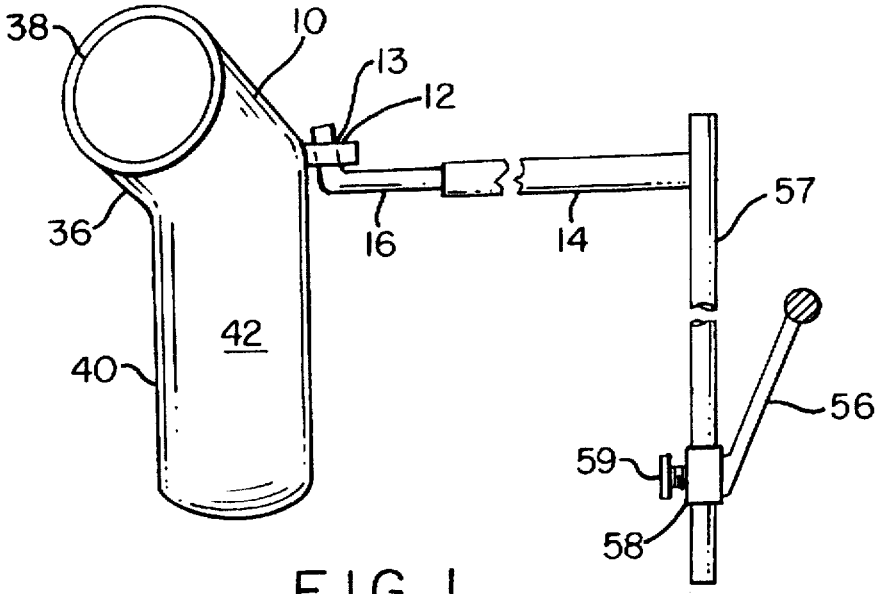
FIG. 1 depicts a sectioned side view of a portable urinal in accordance with the present invention, showing detail of a preferred embodiment of a urine bottle.
Figure 2:
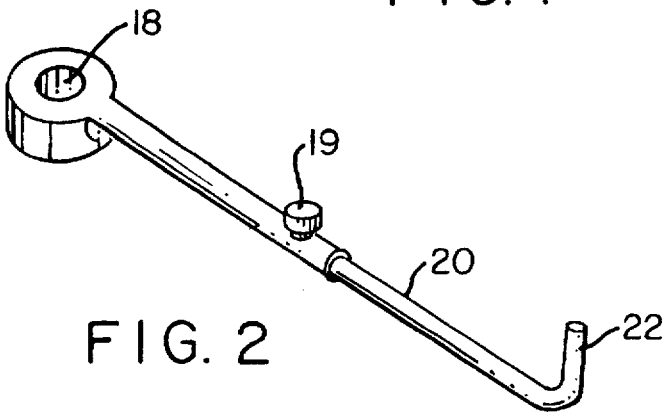
FIG. 2 depicts a perspective view of the preferred embodiment of a urine bottle support of the portable urinal depicted in FIG. 1.

FIG. 1 depicts the preferred embodiment of the present invention which overcomes the problems typical of the art by providing a portable urinal having a urine bottle support and a urine bottle 10 that is selectively removable from the urine bottle support. The urine bottle support comprises a hollow rod 14 and an extension rod 16 disposed within the hollow rod 14 such that the extension rod 16 is selectively moveable in a longitudinal direction relative to the hollow rod 14. As depicted in FIG. 2, a stop screw 19 may be utilized to selectively lock the length of extension of the extension rod 16, although the inclusion or exclusion of this stop screw is not critical to the invention.

It can be seen in FIG. 2 that the urine bottle support has a receiving area 18 which in the preferred embodiment is integral with said hollow rod 14. FIGS. 1 and 2 illustrate that the extension rod 16 comprises a body portion and an end portion such that the end portion and the body portion form a generally ninety degree angle therebetween. The preferred angle formed is ninety degrees, but the exactness of the angle is not crucial; as such a large margin of error is tolerable. In a second embodiment of the invention (not shown) the receiving area 18 is integral with the extension rod 16 and the hollow rod 14 includes a body and an end portion which form a generally ninety degree angle therebetween.

The urine bottle 10 of the preferred embodiment comprises an elongate bottle 40 having an exterior surface 42, an inclined entrance end 36 that has an opening 38 and a handle 12 which has a first receiving area 13. As illustrated in FIG. 1, the handle 12 is integral with the exterior surface 42 of the urine bottle 10. In the preferred embodiment, the urine bottle 10 is selectively coupled to the urine bottle support when the end portion 22 of the extension rod 16 is received by the first receiving area 13 of the urine bottle 10. In the second embodiment of the invention, the urine bottle is selectively coupled to the urine bottle support when the end portion 22 of the hollow rod 14 is received by the first receiving area 13 of the urine bottle 10. In both of these embodiments, when the urine bottle 10 is coupled to the urine bottle support the urine bottle 10 is positioned in a generally vertical position relative to the floor.

Figure 3:
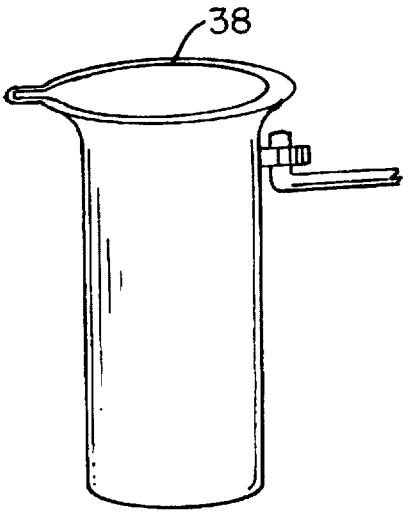
FIG. 3 depicts another embodiment of a urine bottle of the portable urinal depicted in FIG. 1.

FIG. 3 depicts another embodiment of the invention that may be utilized by women. In this embodiment the opening 38 of the urine bottle 10 has a generally oval shape with an elongate opening at one end thereof. In the preferred embodiment the longest diameter of the oval is four (4) inches long and the widest diameter is two and one haft (2.5) inches wide. The elongate opening makes up approximately one (1) inch of the 4 inch diameter. It will be apparent to one skilled in the art that these measurements are merely exemplary and may be varied without detracting from the utility of the invention.

Figure 2A:
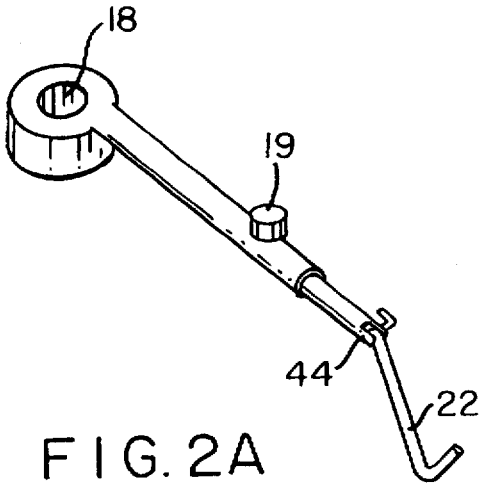
FIG. 2A depicts a perspective view of another embodiment of the urine bottle support depicted in FIG. 1 showing detail of a hinged portion of the urine bottle support.

In another embodiment of the present invention depicted in FIG. 2A, the extension rod 16 includes a hinge 44 disposed within the body portion 20 of the extension rod 16. Utilizing the hinge 44 an individual can change the angle of the urine bottle 10 relative to the ground by raising or lowering a portion of the extension rod 16 proximal the end portion 22 of the extension rod 16. The hinge portion may be connected to a locking member for locking the position of the urine bottle 10 once the desired position is determined.

Figure 4:
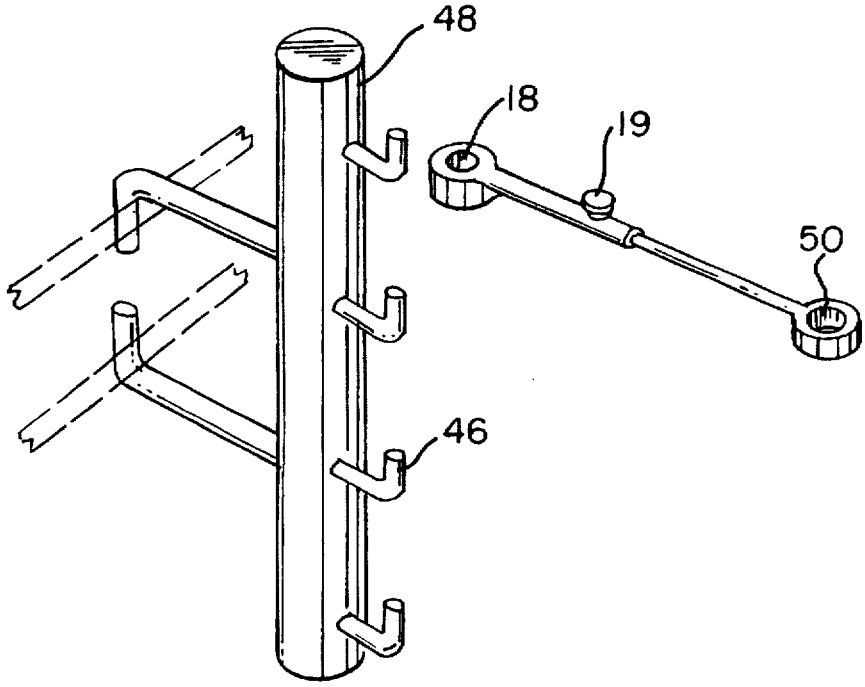
FIG. 4 depicts a perspective view of another embodiment of a urine bottle support of a portable urinal in accordance with the present invention.
Figure 5:
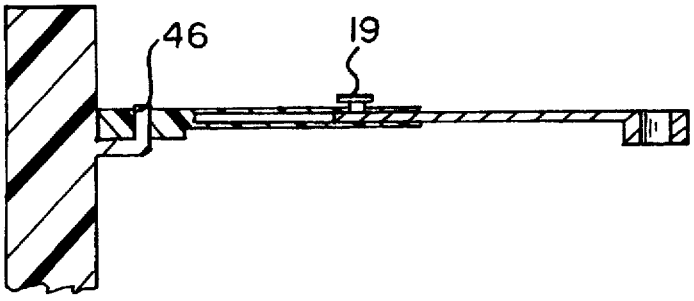
FIG. 5 depicts a sectioned side view of the urine bottle support depicted in FIG. 4.
Figure 6:
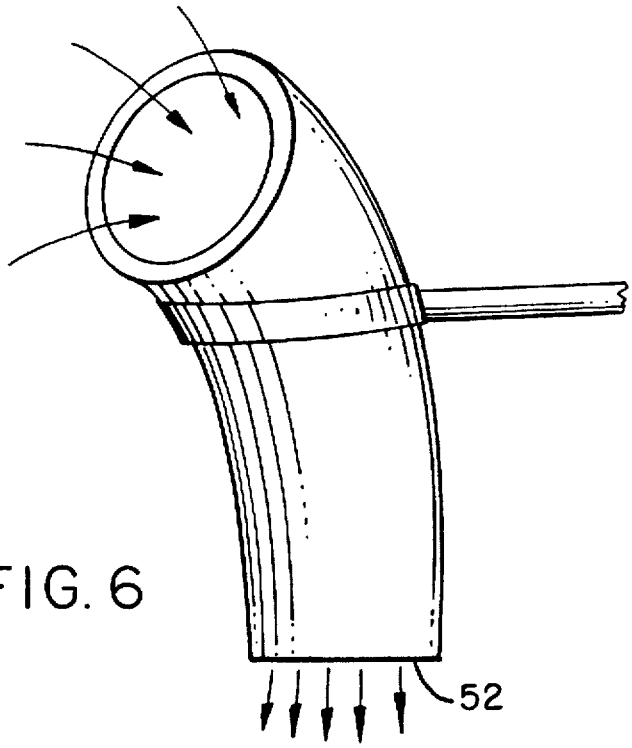
FIG. 6 depicts an embodiment of a urine bottle for use with the urine bottle support depicted in FIG. 4.
Figure 7:
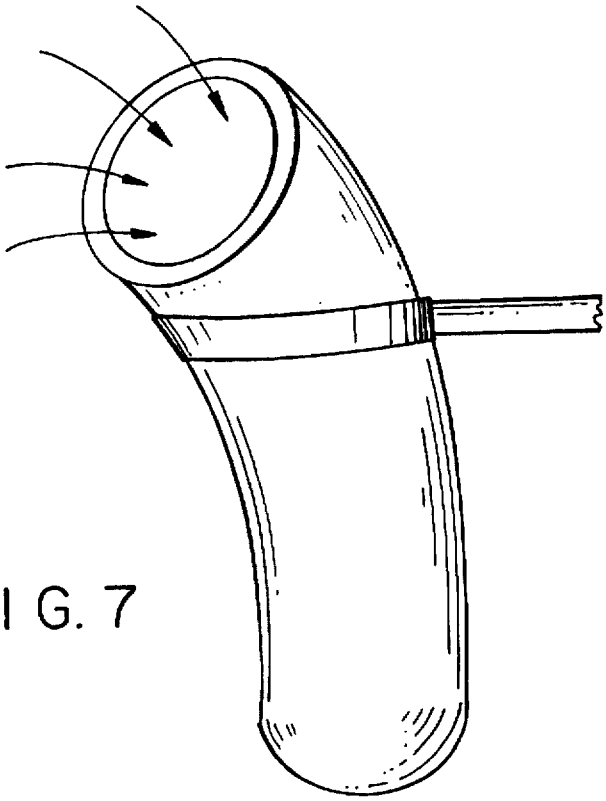
FIG. 7 depicts a second embodiment of a urine bottle for use with the urine bottle support depicted in FIG. 4.

FIG. 4 illustrates that the portable urinal can be coupled to most standard walkers. The portable urinal may be coupled to the walker when receiving area 18 receives walker rod 46 as illustrated in FIG. 5.

FIGS. 4–7 illustrate a fourth embodiment of the present invention wherein the urine bottle support has a bottle receiving area 50. In this embodiment, the urine bottle 10 does not need the handle 12 although the presence of the handle 10 would not interfere with the connection of the urine bottle 10 to the urine bottle support. In this embodiment, the urine bottle 10 is coupled to the urine bottle support by inserting urine bottle 10 into the bottle receiving area 50. In a further embodiment, the urine bottle 10 has a second opening 52 in a bottom of the urine bottle 10 for directing urine into a toilet bowl.

Figure 8:
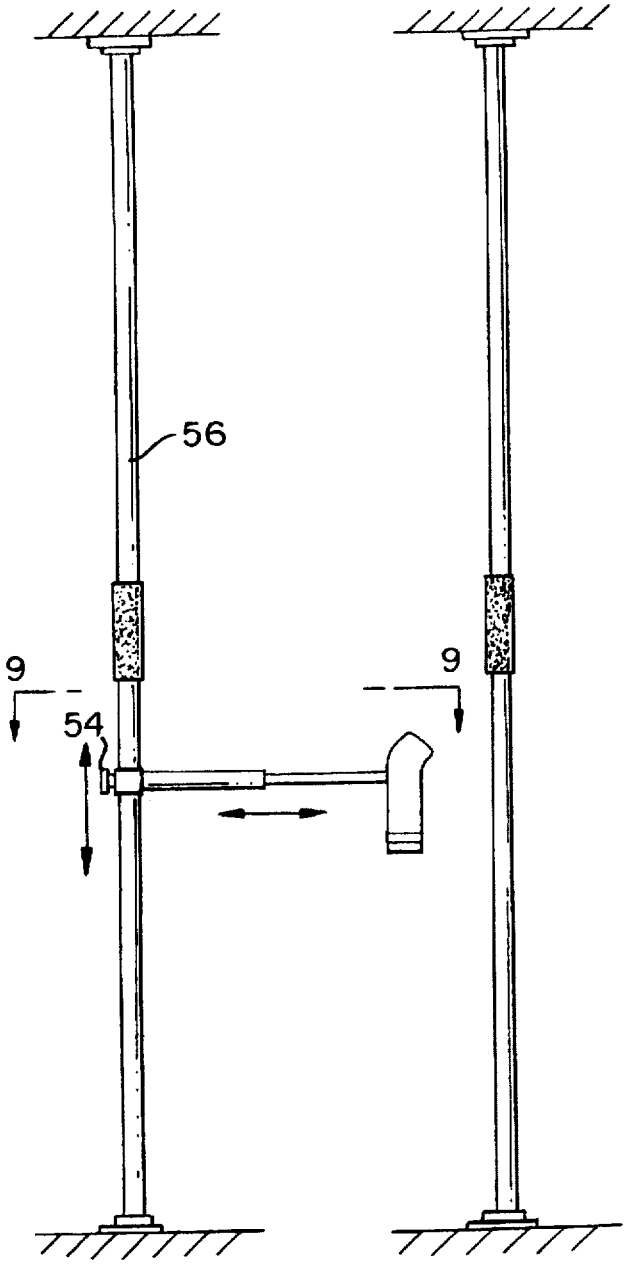
FIG. 8 depicts a side view of an embodiment of a portable urinal in accordance with the present invention, showing detail of a support pole extending between a ceiling and floor.
Figure 9:
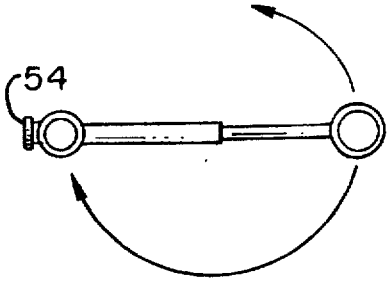
FIG. 9 depicts a top view of a urine bottle support as depicted in either FIG. 2 or 4 showing detail of a tightening screw for height adjustment of the urine bottle support.
Figure 10:
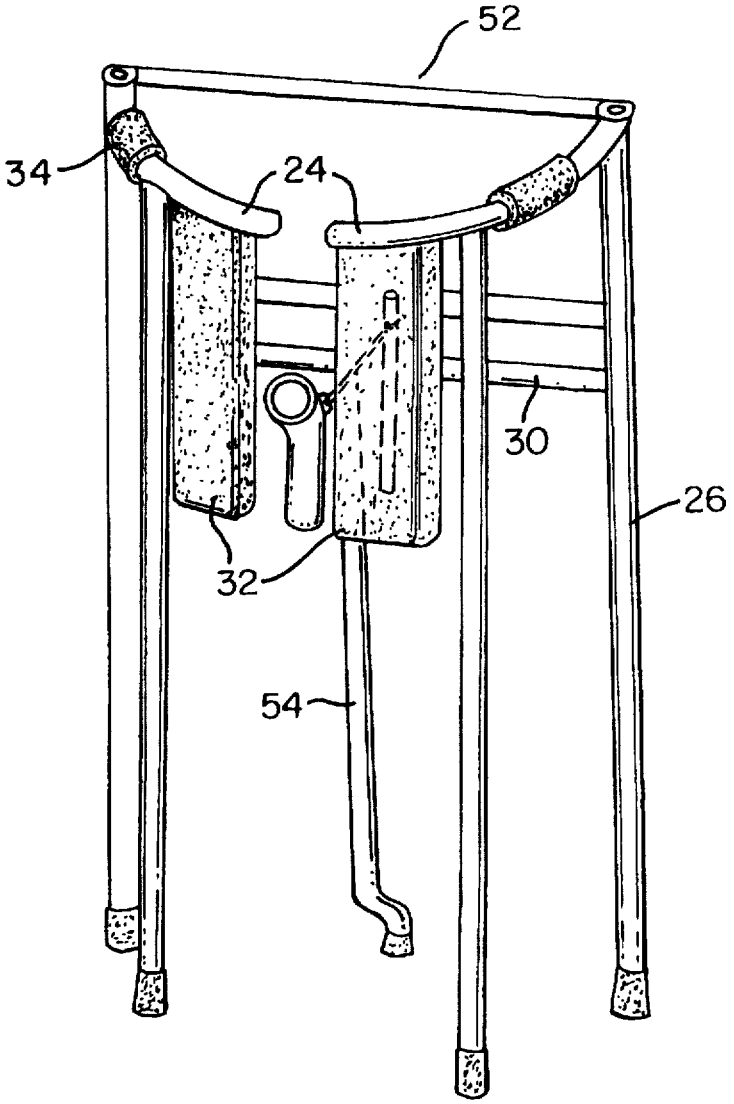
FIG. 10 depict a perspective view of an embodiment of a portable urinal in accordance with the present invention showing detail of a collapsible stand.
Figure 12:
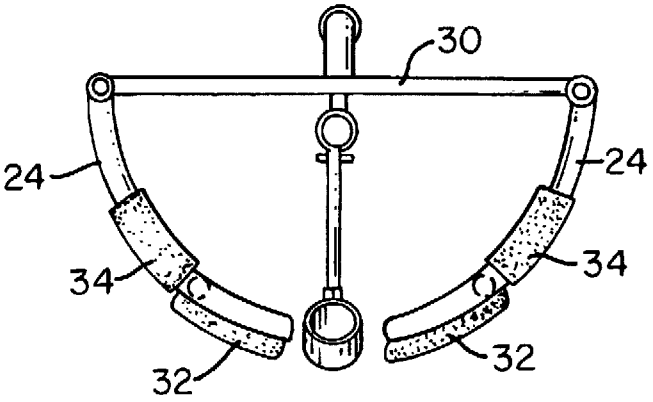
FIG. 12 depicts a top view of the collapsible stand of FIG. 10.

In yet another embodiment of the present invention, receiving area of the urine bottle support includes a setting screw 54, as depicted in FIGS. 8 and 9 for selectively locking the urine bottle support in place. There is also a standing pole 56 which is received by the receiving area of the urine bottle support. The standing pole 56 preferably extends from the floor to the ceiling, but may be just as effective without rising to the ceiling so long as it is supportive of an individual utilizing the present invention. The urine bottle support may be raised or lowered along the standing pole 56 to a desired height, then locked into place by the setting screw 54. Further, the setting screw enables an individual to rotate the urine bottle support around the standing pole 56 so that if it is not needed it is out of the way of a person utilizing the toilet. A second standing pole may be utilized for further support of an individual utilizing the present invention.

Figure 13:
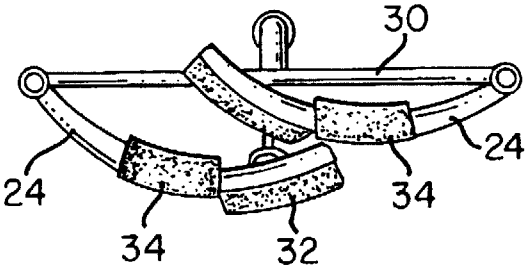
FIG. 13 depicts a top view of the collapsible stand of FIG. 10 in a collapsed position.
Figure 11:
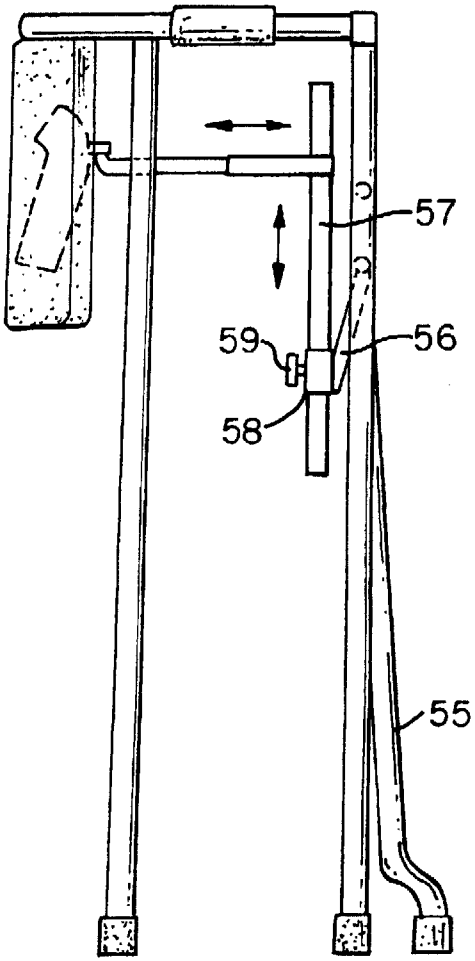
FIG. 11 depicts a side view of the collapsible stand of FIG. 10.

In yet another embodiment of the invention shown in FIGS. 10–13 the urine bottle support may be connected to a collapsible stand 52. The collapsible stand 52 has legs 26, arms 24 attached to the legs 52 and crossbars 30 connecting the legs 26 together. The collapsible stand 52 also has a support member rotatably connected to one of the crossbars for supporting and positioning the urine bottle support. The support member as depicted in FIG. 11 preferably has four parts a leg 55, a support arm 56 hingedly connected to the leg 55, the support arm having a rod receiving area 58, a vertical positioning rod 57 disposed within the rod receiving area 58 and selectively movable in a generally vertical direction relative to the ground, and a screw 59 disposed within the support arm 56 located at the rod receiving area such that the screw 59 contacts the vertical positioning rod 57 to selectively lock the vertical positioning rod 57 at a selected position. The urine bottle support connects to the collapsible stand when the vertical positioning rod 57 is received by the receiving area 18 of the urine bottle support. The collapsible stand 52 may also include thigh pads 32 attached to and extending down from the arms 24 such that the urine bottle support is located between the thigh pads 32. The collapsible stand 52 may also include hand grips 34 attached around the arms 24. The size of these pads and grips may vary in thickness and in length without detracting from the invention. The collapsible stand may be folded for storage or travel by folding the arms 24 in a direction towards the crossbars 30 as shown in FIG. 13.

It will thus be seen that the invention efficiently attains the objects set forth above, among those made apparent from the preceding description. In particular, the invention provides a portable urinal. Those skilled in the art will appreciate that the configurations depicted are distinguishable over the art.

It will be understood that changes may be made in the above construction and in the foregoing sequences of operation without departing from the scope of the invention. It is accordingly intended that all matter contained in the above description or shown in the accompanying drawings be interpreted as illustrative rather than in a limiting sense.

It is also to be understood that the following claims are intended to cover all of the generic and specific features of the invention as described herein, and all statements of the scope of the invention which, as a matter of language, might be said to fall therebetween.

Having described the invention, what is claimed as new and secured by Letters Patent is:

1. A portable urinal comprising:

a urine bottle support for holding a urine bottle, said urine bottle support having a receiving area through which an elongated support may extend to support the urine bottle support such that when said urine bottle support is being supported by said elongated support said urine bottle support forms a substantially right angle with said elongated support, said urine bottle support comprising:

a hollow rod;

an extension rod disposed within said hollow rod, said extension rod being selectively movable in a longitudinal direction relative to said hollow rod;

said extension rod including a body portion and an end portion, wherein said end portion forms a generally ninety degree angle with said body portion, and said end portion is formed such that it is selectively receivable by said first receiving area; and a urine bottle selectively coupled to said urine bottle support;

said urine bottle comprising an elongate bottle having an exterior surface, an inclined entrance end that has an opening, and a handle having a first receiving area said handle being integral with said exterior surface, said urine bottle being coupleable to said urine bottle support by said first receiving area, such that when said urine bottle is coupled to said urine bottle support said urine bottle is positioned in a generally vertical position; and a collapsible stand coupled to said urine bottle support comprising:

a plurality of arms;

a plurality of legs coupled to said plurality of arms;

a crossbar coupled between two of said plurality of legs; and a height adjusting bar selectively coupled to said crossbar, said height adjusting bar being selectively movable in a vertical direction relative to said crossbar.

2. The portable urinal as claimed in claim 1 further including:

a plurality of thigh pads coupled to said collapsible stand configured such that said urine bottle is positionable between said thigh pads.

3. The portable urinal as claimed in claim 1 further including:

a plurality of thigh pads coupled to said collapsible stand configured such that said urine bottle is positionable between said thigh pads.

* * * * *